United States Patent [19]

Newsome

[11] 4,241,533

[45] Dec. 30, 1980

[54] AERIAL TOY GLIDER

[76] Inventor: Reginald W. Newsome, 216 Philray Rd., Richmond, Va. 23229

[21] Appl. No.: 21,117

[22] Filed: Mar. 16, 1979

[51] Int. Cl.[3] ..... A63H 33/18

[52] U.S. Cl. ..... 46/74 D

[58] Field of Search ..... 46/74 R, 74 D; 2/171, 2/195, 196, 209.1; 273/106 B

[56] References Cited

U.S. PATENT DOCUMENTS

| | | | |
|---|---|---|---|
| 2,080,489 | 5/1937 | Knorpp | 273/106 B |
| 2,696,007 | 12/1954 | Larkin et al. | 2/171 |
| 2,864,201 | 12/1958 | Leise | 273/106 B |
| 3,056,969 | 10/1962 | Speros | 2/171 |
| 3,724,122 | 4/1973 | Gillespie | 46/74 D |
| 4,115,946 | 9/1978 | Vukmirovich | 46/74 D |
| 4,201,009 | 5/1980 | Burridge | 46/74 D X |

FOREIGN PATENT DOCUMENTS

| | | | |
|---|---|---|---|
| 1603662 | 6/1971 | France | 46/74 D |

*Primary Examiner*—F. Barry Shay

*Attorney, Agent, or Firm*—George M. J. Sarofeen

[57] ABSTRACT

A foldable, pocketable aerial toy glider is made of flexible sheet material supported and shaped by attachment to a resilient perimeter forming bodying member comprising good memory characteristics. The sheet material central portion is loose and becomes dished upwardly during flight.

7 Claims, 5 Drawing Figures

AERIAL TOY GLIDER

FIELD OF THE INVENTION

The present invention relates to the field of toy gliders of generally disc-like shape which are thrown by hand to cause them to fly a limited distance. More particularly, the glider of the present invention is made foldable for carrying in a pocket.

BACKGROUND ART

Prior art devices have been of saucer-like configurations and of relatively rigid construction. Some attempts have been made to provide a pocketable disc-like glider, and one such of these has been formed as a cloth disc with weights sewn into the perimeter.

DISCLOSURE OF INVENTION

The present invention as described in this application is made disc-like and with a flexible inner disc portion secured to and lying within a perimeter of a rim member made resilient foldable of semi-rigid material. The rim member is sewn or sealed within an enclosure of sheet material which is then sewn or adhered to the inner disc to form a substantially tubular rim retainer member. The inner disc is made slightly larger in diameter than is needed to exactly meet the rim at the periphery to allow for the inner disc to deflect in a dome-like bulge dished away from that side of the glider which is subjected to the greater source of air pressure. This distention is thought to result in producing an aerodynamic airfoil configuration which functions to provide lift to the glider as it skims through the air.

The present mode of the invention is illustrated as being constructed as sewn of woven fabrics with the rim member enclosed in the rim retaining member in much the small manner as an enclosure used in cording trim as conventionally used in fabric assemblies. The rim member is made bulbous in cross section and is thought to function as a lift producing leading edge causing creation of an area of reduced pressure in an annular recess created just inside the rim assembly 11. A glider made in accordance with the present invention appears to take on flight characteristics of a unique nature which are thought to be peculiar to the particular construction of this invention. In addition to the thicker rim, the doming action and the annular recess formed in the loosely stretched inner disc is made to further produce lift as the flyer is hand propelled edgewise for flight.

The construction of the present invention may be carried out in several ways. It may be of heat-sealed plastic material or of a synthetic or a natural fabric woven or unwoven. The materials may be assembled by using adhesives, by stapling or other means to bond the several members to each other. The rim member may be made of a solid rod or of a tubular member or may be formed of a foamed rod of suitable density and cross section. A principal function of the rim member other than its function as an airfoil is to provide a suitable degree of rigidity sufficient to enable the glider to fly and yet allow it to be foldable so that the whole may be compressed for carrying in a pocket in a piece of clothing, a handbag or other such enclosure. It is also important to make the rim member of a material having good memory characteristics so that on being unfolded after an extended period of storage, the rim member will return to the original shape as originally designed and made to impart to the glider the original shape flight characteristics.

A novel and unexpected result which has been observed in the practice of the present invention is the effect on flight performance which is experienced for contours of different shape in the perimeter of the glider. A truncated disc design causes the glider to perform differently in flight than a pure circular form. A spinning motion imparted to a glider with a truncated perimeter causes variegated flight gyrations to occur during flight.

BRIEF DESCRIPTION OF THE DRAWINGS

The present invention is described in the preferred embodiment disclosed herein with reference to the drawings in which.

BEST MODE FOR CARRYING OUT THE INVENTION

Figure 1:
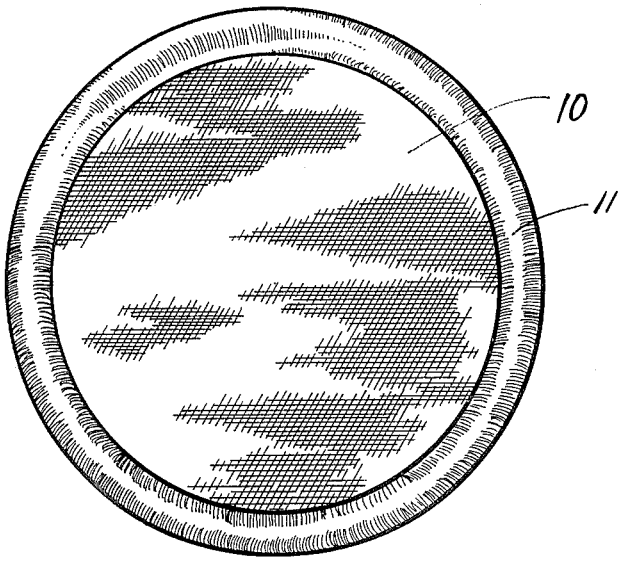
FIG. 1 is a plan view from the top of a circular glider.
Figure 2:
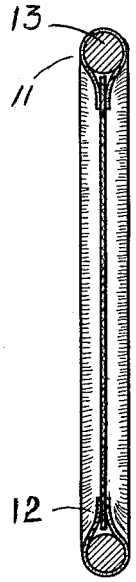
FIG. 2 is a cross section taken through a diameter of FIG. 1.

In FIG. 1 is shown a circular glider which is made with a fabric disc 10 joined at its periphery to a rim member retainer and rim member combination 11 by means comprised of a rim member retainer 12 enclosing the rim member 13 which is made of a flexible rod of foam rubber or the like. The fabric disc 10 is preferably made oversize in order to allow for extra fabirc which is allowed to lie rather loosely for the purpose of causing a doming of the inner portion to occur during flight. The disc 10 and the rim member retainer 12 are secured together at the inner edge of the rim member retainer 12 by sewing or adhesion by use of an adhesive or a heat-sealing process for fusing heat-sealable coverings in place of sewing. In assembling the glider, I prefer to first enclose the rod 13 within the rim member retainer 12 and sew the whole assembly together by conventional sewing techniques.

My gliders can thus be made with certain variations as desired. Such variations are differences of design of perimeter such as square, triangular, or as many sides as desired to create different flight characteristics.

Figure 3:
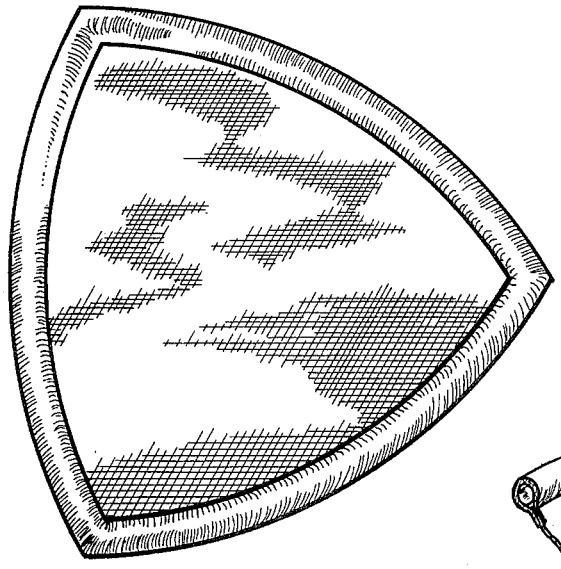
FIG. 3 is a glider with a truncated arcuate perimeter.
Figure 4:
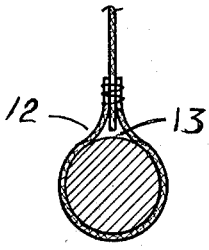
FIG. 4 is an enlarged section of one end of FIG. 2.
Figure 5:
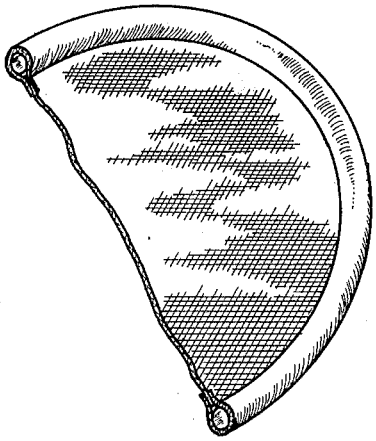
FIG. 5 is a partially broken view in perspective of the glider of FIG. 1.

In another alternative construction, I provide arcuate sides such as shown in FIG. 3 of the drawings for their own particular effect on the glider in flight. The glider flies differently with the arcuate truncated sides as shown than when made in pure circular form or when straight sided truncations are provided.

Another feature of the invention which is thought to provide lift to the glider is the fact that the rim is made thicker than the center portion. The thicker edge is thought to have an aerodynamic effect in that as the glider is propelled through the air an area of lowered pressure is created on the upper side of the glider in comparison to the pressure on the bottom side of the glider as a result of the doming action of the central portions as previously described. The combinations of the thick rim and the domed center are thought to combine to create an airfoil which causes lift to occur by reducing air pressure on the top domed surface of the glider to cause it to fly.

Other variations in detail of configurations and substitution of materials may be resorted to by those skilled in the art without departing from the spirit and scope of my invention. My description of the preferred mode of practicing my invention is to be taken to be illustrative but not limiting.

In view of this and to better define what I consider to be the scope of my invention, what I claim is:

1. An aerial toy glider adapted to be thrown through the air and having an aerodynamic lifting surface comprising:

a peripherally arcuate rod-like rim member of resilient foam material with elastic memory characteristics;

a peripherally arcuate, substantially tubular rim retaining member of flexible material for receiving said rim member;

said rod-like rim member lying within said rim retaining member;

means for securing said rim member within said rim retaining member;

a peripherally arcuate disc-like body member of flexible, non-resilient material;

means for securing said rim retaining member and said rim member to said body member along a line of common periphery of said rim retaining member; said rim member being made of material of sufficient rigidity so that said glider may be folded for storage in a restricted space and then return to its original shape upon being unfolded, based on the said memory characteristics of said rim member;

said disc-like body member being made of a diameter larger than the inner diameter of said rod-like rim member;

said larger diameter of said disc-like body member being made of a preselected magnitude so that on being deflected by air resistance during flight, said disc-like body member becomes dished in a vertical direction along an axis normal to the horizontal plane of said disc so that an annular recess is formed adjacent said rim near the junction of said body member and said rim retaining member forming an angle at said junction for providing an area of lowered pressure behind and adjacent the rim member as said disc is thrown through the air.

2. The glider of claim 1 wherein said rim member is of substantially circular design.

3. The glider of claim 1 wherein said rim member is made multi-sided in form.

4. The glider of claim 1 wherein said rim member is made in the form of a truncated circle.

5. The glider of claim 4 wherein said truncations are arcuate in form.

6. The glider of claim 1 wherein at least one member is of a plastic material.

7. The glider of claim 1 wherein at least one member is of a woven cloth material.

* * * * *